United States Patent [19]

Chaffin

[11] 4,100,981

[45] Jul. 18, 1978

[54] EARTH BORING APPARATUS FOR GEOLOGICAL DRILLING AND CORING

[76] Inventor: John D. Chaffin, 851 Haverford Ave., Pacific Palisades, Calif. 90272

[21] Appl. No.: 765,679

[22] Filed: Feb. 4, 1977

[51] Int. Cl.[2] ..... E21B 49/00; E21B 7/18; E21B 21/00

[52] U.S. Cl. ..... 175/60; 175/69; 175/71; 175/171; 175/215; 175/213

[58] Field of Search ..... 175/60, 69, 71, 70, 175/173, 171, 215, 212, 213

[56] References Cited

U.S. PATENT DOCUMENTS

| | | | |
|---|---|---|---|
| 1,876,627 | 9/1932 | Davis et al. | 175/215 |
| 2,657,016 | 10/1953 | Grable | 175/215 |
| 3,291,229 | 12/1966 | Houston | 175/60 |
| 3,807,514 | 4/1974 | Murrell | 175/60 |
| 3,887,020 | 6/1975 | Chaffin | 175/60 |
| 3,968,845 | 7/1976 | Chaffin | 175/60 |

*Primary Examiner*—James A. Leppink
*Attorney, Agent, or Firm*—William H. Maxwell

[57] ABSTRACT

Apparatus for concentric multi-string drilling with reverse air vacuum for the entrainment of chips and dust, selectively controlled through a plurality of annuli defined by the multiplicity of drill strings adapted to individually and/or cooperatively operate drill bits and reamers and the like to bore geological formations as required.

58 Claims, 13 Drawing Figures

18
19
M
R
10
17
59
14
13
20
21
22
23
24
25
28
27
V1-S
11
16
A
F
31
X
Y
Z
12
15
P1
P2
P3
P4
V1
V2
V3
V4
V5
a
b
c
d
x

EARTH BORING APPARATUS FOR GEOLOGICAL DRILLING AND CORING

FIELD OF INVENTION

This invention pertains to the drilling and coring of earth formations with multi-strings of concentric drill pipe operating one or more drilling tools, and utilizing reverse air vacuum for sampling the formation and for disposing of the same.

PRIOR ART

The boring of wells for the acquisition of mineral deposits and the like has involved singular drill columns for the operation of bits that dig and size the well bore. There are various methods of drilling, the most common being the rotary method wherein the drilling column is rotated by a Kelly depending through a rotary table with liquid pumped through the string of drill pipe to flush the chips upwardly out of the annulus surrounding said string. A more sophisticated method of vacuum drilling and coring is disclosed in U.S. Pat. No. 3,291,229, issued Dec. 13, 1966 wherein a hollow drill string is revolved by motor and transmission means at the head thereof, and all of which moves vertically relative to a supporting drilling rig; the chips and particulate matter being withdrawn through the drill string and collected in separators. Further development of the art is disclosed in U.S. Pat. Nos. 3,887,020 and 3,968,845, issued June 3, 1975 and July 13, 1976 respectively, wherein there is apparatus and method for complete reverse air vacuum drilling by entrainment of chips and dust in a high velocity air stream created by applying a vacuum to the drill stem or annulus of a drilled hole, removing the drilled particles by entrainment in the flow of air created by the vacuum and collection of the drilled particles for visual or other analysis. In these latter two patents the stem is rotated by an elevated single speed drive through which the upper end of the stem extends. Characteristic of these patent disclosures and of the known prior art, singular bits are operated by singular strings of drill pipe.

BACKGROUND

The penetration of geological formations by rotary drilling methods requires the circulation of fluids for the removal of particulate matter. Heretofore, both liquid and air (gas) have been circulated under high pressure through the drilling string and the pipe-to-bore annulus surrounding the same; and for the purpose of flushing or retrieving drilled chips from the bottom of the well bore. A limiting factor in such drilling operations has been the singular fluid circuit, either the pressured (downward) circulation of mud or the reverse (upward) vacuum circulation of air; and also a limiting factor is the operation of singular drilling strings in such well bores. It is a general object therefore, to provide a new drill rig drive and coaxial drill strings for the circulation of separate fluids and for the operation of separate drilling tools. With the present invention there is a drive at the head of a multiplicity of concentric drill pipes and between which there are annuli for conducting separate columns of fluid, each drill pipe being independently capable of operating a well drilling or servicing tool such as a bit or reamer.

Drill string drives have been carried by drilling rigs to move relative thereto at the uppermost end of the drilling string operated thereby. To these drives there have been various fluid attachments, such as a rotary hose attachment through a swivel, and to the end that there is fluid column (singular) communication through the inner diameter of the drill string. This invention involves a multiplicity of drill strings and a plurality of separate fluid circuits to well tools and servicing means at the bottom of the drill string, it being an object to provide a driving head at the top of said multiplicity of drill strings to revolve the same in manifold communication with fluid pressure sources and through separate fluid circuits. With the present invention there is a multiplicity of concentric drill pipes, for example four drill pipes, coaxially driven together with annuli therebetween so as to conduct separate columns of fluid coextensively therethrough, there being a swivel-manifold for supplying and withdrawing fluid from the top ends of the drill pipe annuli respectively.

Singular drilling tools have been restrictively operated by drill strings at or near the bottom of the well bore being dug; and dependent upon singular fluid circulation. It is an object of this invention to provide for the simultaneous operation of a plurality of drilling tools by means of separate and distinct drill strings; and with independent fluid circulation therethrough as circumstances require. With the present invention, any one of the multiplicity of drill strings or pipes can be employed to operate a drilling tool and/or employed to deploy or retrieve fluids employed to best advantage in the drilling operation.

Drilling operations become involved with collapsing geological formations etc., and ultimately there is the withdrawal of the drill string and its replacement with well casing. It is an object of this invention to provide for the conversion of a drill string into a well casing, and for the independent withdrawal of the other drill string or strings. With the present invention, the multiplicity of drill strings can be disconnected or interconnected one from the other, so that both simultaneous operation and independent removal from the well bore is feasible.

The multiple drill string drive of the present invention not only operates a multiplicity of drill pipes, but conducts separate columns of fluid through the annuli therebetween. It is an object therefore to provide equalibrium in an anti-friction drive that simultaneously rotates the multiplicity of drill pipes, and to assemble sections thereof in concentric relation so as to be handled with facility as units. A feature of this invention is the uniform inside and outside diameters of the drill pipes with anti-spread means at the threaded pin and box couplings thereof. And in accordance with this invention, the multiplicity of drill pipes are assembled into sections with spreader means so as to ensure concentricity and also to provide the said assembly thereof when circumstances require.

It is also an object of this invention to correlate the foregoing general objectives as they are embodied primarily in a "Top Head Drive" of extreme rugedness adapted to separately conduct liquids at high pressure and gaseous fluids at high vacuum through the annuli between the multiplicity of drill pipes. There is a unique balance of drive means that transmits torque into the drill strings, in such a manner that complete control is attained over direction of rotation, speed and power to be applied. And, despite the ultimate power that is available through this "Top Head Drive", the drilling rig required for its operation is devoid of complexity and/or over-structure, and all to the end that portability into otherwise inaccessible drilling locations is made possible.

SUMMARY OF INVENTION

The present invention is described as "Multi String Reverse Air Vacuum Drilling", utilizing concentric strings of drill pipe operating one or more rotary bits and/or reamers. Unique with this invention is the "Top Head Drive" that rotates co-axial drilling strings which operate drilling tools such as a bit or bits and reamers as the case may be. A feature therefore is the annuli that occur between the concentric walls of the multiplicity of drill strings, and which are selectively employed to conduct air to and from the boring area for acquisition of the particulate matter of the formation through which the bore penetrates. A reverse air vacuum system is employed to provide a high velocity air stream or streams to suck the cuttings off the drilling tool, thereby maintaining a clean well bore and to the end that the drill or drills are kept clean and upon a solid bottom for well bore contact at all times. A feature is the containment of the pressure and vacuum air flow within the annuli, without reliance upon the outer drill pipe-to-well bore annulus for circulation. Consequently, when fissures, cracks or tunnels are encountered down the hole it is impossible to lose circulation, as and when the drill bit drops through tunnels or open spaces or when excess water is encountered and must be packed-off. Characteristically therefore, various well servicing operations can be performed, such as conversion of the outermost drill pipe into a well casing, and back-off operations conducted independently with the use of quick setting chemical agents forced into the formation while drilling on the reverse air vacuum principle is continued and/or subsequently resumed.

DRAWINGS

The various objects and features of this invention will be fully understood from the following detailed description of the typical preferred form and applications thereof, throughout which description reference is made to the accompanying drawings, in which.

PREFERRED EMBODIMENT

Figures 1, 2, 3:
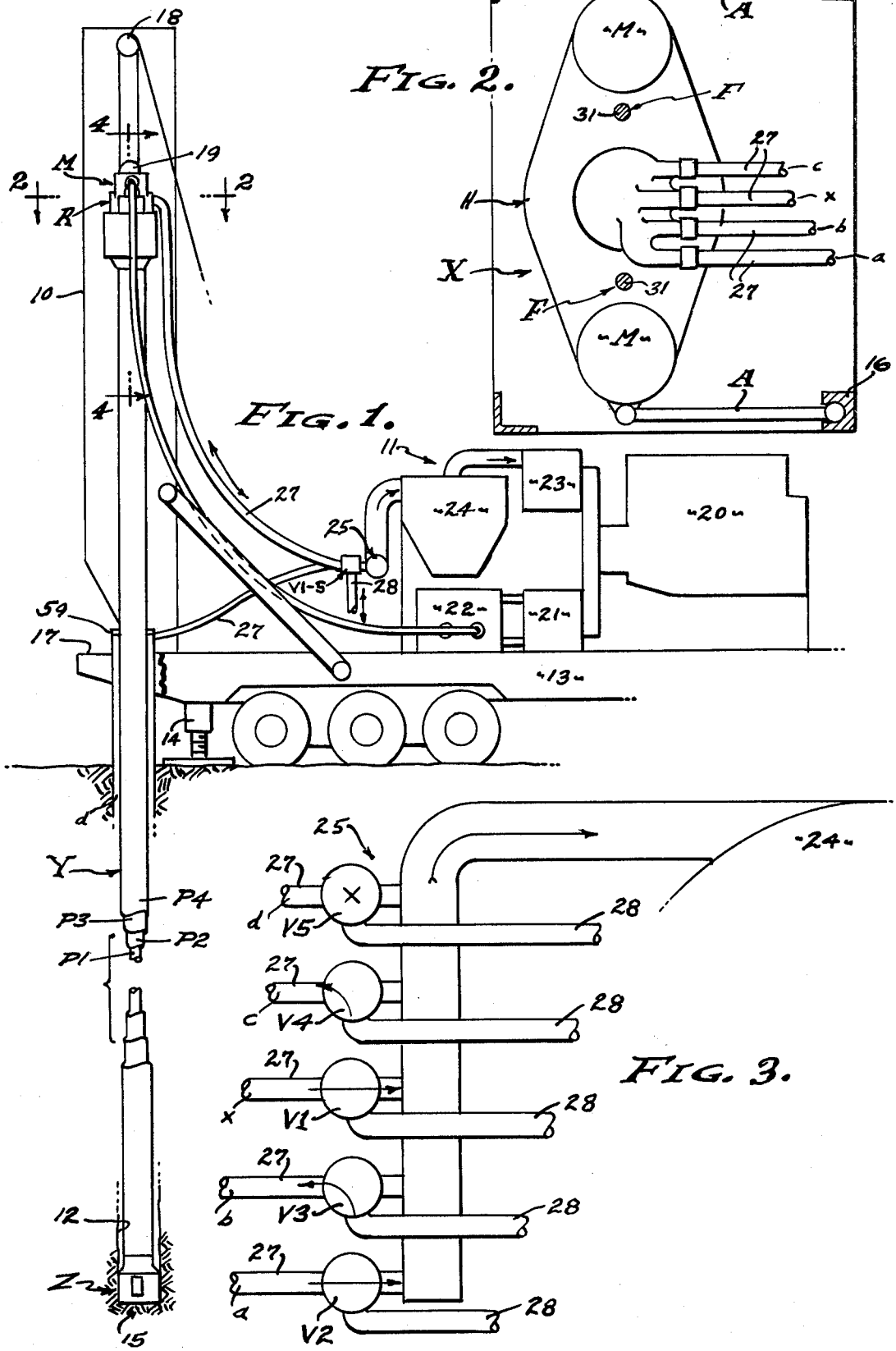
FIG. 1 is a schematic side elevation showing the rear portion of a portable rig embodying the present invention.
FIG. 2 is an enlarged sectional view taken as indicated by line 2—2 on FIG. 1.
FIG. 3 is an enlarged fragmentary plan view of the controlling manifold, removed from FIG. 1.

Referring now to the drawings, the Top Head Drive X is shown operatively positioned in a derrick 10 of a portable rig 11 to operate a drill string Y with drilling tools Z at the bottom of a well bore 12. The chassis 13 of the rig is leveled as by means of jacks 14 with the drill string in alignment with the well bore extending through a geological formation 15. The derrick can vary widely to include columns 16 extending upward from the derrick floor 17 or chassis of the portable rig, as shown, with a crown-block 18 and a traveling-block 19 to elevate the Top Head Drive X with the drill string Y depending therefrom, and with the drilling tools Z in digging engagement with the bottom of the well bore 12. In accordance with this invention, the Top Head Drive X is hydraulically operated to drive the drill string of multiple drill pipes, and a plurality of high vacuum air circuits are adapted to be in communication with the central drill pipe bore *x* and annuli *a, b, c,* and *d* established by the multiplicity of the four drill pipes shown; it being understood that the number of drill pipes in said multiplicity thereof can vary as circumstances require. Accordingly, the drill rig includes a prime mover 20 that operates a hydraulic pressure means 21 which supplies liquid under pressure through transmission control means 22 such as a hydrostatic transmission with complete control over the hydraulic fluid flow; as to pressure, volume and direction. The drill rig also includes a high vacuum means 23 that selectively draws air from the bore *x* and annuli *a, b, c,* and *d* and through a separator means 24. In practice, the means 23–24 draw fluid through a manifold means 25 comprised of a vacuum header 26 and selector valves V1 through V5 for control over the bore *x* and annuli *a–d*. As shown, there is a flexible hose connection 27 from each valve V1–V5 to its corresponding bore or annulus (*x, a–d*) respectively, and operational for open communication therebetween, or to be shut off entirely, or to be diverted to auxiliary connections as circumstances require. For example, any one of said connections 27 can be diverted to a service line 28 for introducing or withdrawing a fluid. Reference is made to the aforementioned patents and the prior art which discloses reverse air vacuum system controls for cyclonic separation and container collection of particulate matter from the well bore, and also for the introducing of other fluids in such a system, wherein:

The method of drilling and recovery of geological material by the reverse air vacuum system reduces the amount of time and work required in taking geological samples because a vacuum system which results in high velocites therethrough of 5,000 to 15,000 fpm is more efficient in lifting the particulate material to the surface than the old high pressure air or water methods. As a result, larger particles can be lifted with attendant reduction in costs associated with drilling to the smaller particle size required by high pressure low velocity systems. Also, high pressure systems are more dangerous to persons working around them, while the reverse air vacuum is less dangerous and positively dust free.

The Top Head Drive X is a bi-laterally symmetrical rotary transmission motorized so as to be in equalibrium when torque is applied thereby. Characteristically, there is a pair of diametrically opposite motors M on axes spaced from and parallel with the central and vertical co-axis thereof. Since extreme angular pressures are applied in order to rotate a multiplicity of drill pipes (four drill strings as disclosed herein), there is anti-friction bearing means B that carry drive cylinders C1 through C4, one for each of said drill pipes respectively, and a carrier plate P embracing gear means G applying torque from each motor M so as to simultaneously rotate all of said drive cylinders. In carrying out this invention, the gear means G from each motor M is embraced by bearing means B operating in upper and lower and intermediate carrier plates P, P1 and P2 respectively, and all of which operates within a housing H. Superimposed over the upper carrier plate P is a swivel-manifold S having a coupling means therethrough so that each of the connections 27 is in open communication with the bore *x* and annuli *a–d* respectively. And, as best illustrated in FIG. 2 of the drawings, anchor means A secures the Top Head Drive carrier assembly against rotation, the said carrier plates P, P1 and P2 being secured together by frame means F, and all of which mounts the motors M with speed reducers R as may be required.

The carrier plates P, P1 and P2 are essentially alike, so that a description of one will suffice for all three; a feature of this invention being the embracement of each gear means G by a pair of carrier plates, one above and one below said means in each instance. Each carrier plate is a frame member disposed in a horizontal plane normal to the central co-axis of the drive cylinders C1–C4, and with an opening 30 therethrough to freely pass the outermost drive cylinder C4. The plates are of substantial thickness or heft and extended laterally in opposite directions to mount the motors M on axes spaced from and disposed parallel with said central co-axis. As will be described, the carrier plates provide for the support of the bearing means B and of the motors M and bearings for the gear means G.

The carrier plates are vertically spaced by the frame means F which comprises tie rods 31 with stops 32 that position the plates relative to each other. In practice, there is a pair of diametrically opposite and parallel tie rods 31, each of which is intermediate a motor drive axis and the central co-axis of the assembly, the rods being threaded and the stops 32 being in the form of nuts threadedly adjustable thereon to position the carrier plates as required. The tie rods are provided with eyes at the top and bottom of the plate assembly, for lifting and pull-down thereof.

The bearing means B are supported in the carrier plates P, P1 and P2 to carry the outermost drive cylinder C4 for rotation, to be driven by the gear means G disposed between each pair of plates. The bearing means B is comprised of carrier bearings 33 supported by each plate, and preferably a pair of axial-radial thrust roller bearings in upwardly and downwardly faced seats 34 and 35; the two roller bearings being disposed oppositely with respect to axial thrust.

The drive cylinder C4 is sectional for its assembly within the carrier bearing means B, and is comprised of carrier rings 37 with downwardly and upwardly faced seats 38 and 39 opposed to the aforementioned seats 34 and 35 respectively. The carrier rings 37 are joined together into assembled cylinder formation, preferably by intermediate drive rings 40, as by means of threaded connection therebetween. The uppermost carrier bearing 33 is retained by a downwardly faced seat 38 of a top seal ring 41, while the lowermost carrier bearing 33 is retained by an upwardly faced seat 39 of a bottom coupling ring 42. In practice, the rings 40, 41 and 42 assemble together with the carrier rings 37 to preload the axial-radial thrust roller bearings 33 in supporting engagement with the carrier plates P, P1 and P2.

Figure 6:
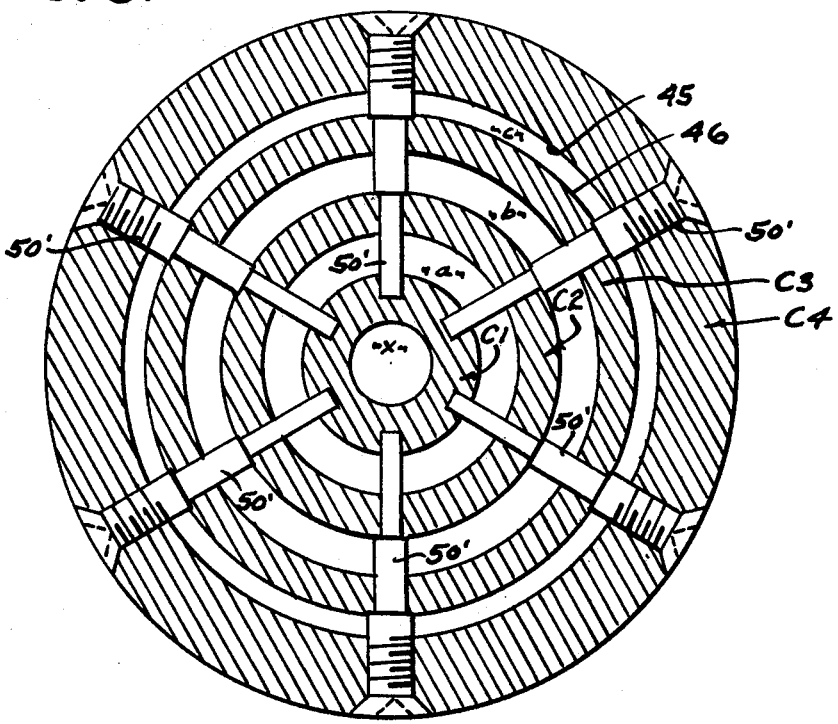
FIG. 6 is an enlarged detailed sectional view of the drive cylinders and taken as indicated by line 6—6 on FIG. 4.

In accordance with this invention, there are a multiplicity of drive cylinders C1, C2, C3, and C4, each essentially a right cylinder characterized by smooth uninterrupted inner and outer walls 45 and 46; with the exception of drive cylinder C4 which, as above described, has an exterior configuration comprised of bearing seats 38 and 39, and also the drive gear means G next to be described. Also, the drive cylinders C1, C2, and C3 differ from drive cylinder C4 in that they are advantageously monolithic with integral drive sections 46, seal sections 47 and coupling sections 48. As shown, the drive cylinders are coaxially concentric tubular members with the annuli *a, b,* and *c* therebetween, and with the bore *x* within the cylinder C1. The drive cylinders are assembled so as to revolve together and they are preferably vertically coextensive one with the other. Accordingly, circumferentially spaced drive pins 50 are threaded radially through the drive sections 46 of the drive cylinders C1, C2, and C3 (see FIG. 4), from the drive rings 40 of the drive cylinder C4. As shown in FIG. 6, there are shouldered drive pins 50' projecting inwardly from each drive ring 40; for example, seated in cylinder C1, with stepped engagement against cylinders C2 and C3, and threadedly locked in the drive ring of cylinder C4. Thus, the drive cylinder assembly is coaxially aligned so as to revolve together as a single unit.

The gear means G is operable between the central co-axis and laterally offset motor M axis (in each instance), on aligned anti-friction bearings 51 seated in the pair of carrier plates embracing said gear means. In practice, the means G is a chain drive comprising a drive sprocket 52 on the motor-transmission shaft 53, a driven sprocket 54 on the drive ring 40, and a continuous chain 55 engaged over said sprockets. A feature of this invention is the balance of angular force application through the symmetrical combination of two diametrically opposite motors M and gear means G applying equal torque to the coaxial drive cylinders C1–C4. As is indicated, each motor M drives through a speed reducer R, and all of which is mounted over the carrier plate extensions at opposite sides of the Top Head Drive; said speed reducer R being remotely controllable for speed changes and/or supplied with controlled fluid from the hydrostatic transmission control means 22 through suitable flexible hose connections.

The housing H is provided for the containment of lubricant surrounding the operational bearings B and drive gear G. Accordingly, a wall 36 encompasses the frame plate assembly P, P1 and P2, with a seal 43 at its sump and a seal 44 at its cover. The seals 43 and 44 run in engagement with the top seal ring 41 and bottom coupling ring 42 respectively, for enclosed lubrication. Provision is made for tempering the lubricant, and shown in the form of a heat exchange element 71 such as a coil or the like for the transmission of a heat transfer fluid therethrough from a conditioner (not shown). In practice, either refrigerated or heated fluids circulate through the coil element 71, so as to condition the lubricant as circumstances require.

The swivel-manifold S couples the bore *x* and annuli *a–c* to the separate flexible hose connections 27, and comprises a manifold header 55 supported over the housing H by the uppermost carrier plate P to enclose the open upper ends of the drive cylinders C1–C4. In accordance with this invention, the manifold header 55 is characterized by concentric seals 56, 57, 58, and 59 engageable with the seal sections 47 of the drive cylinders C1, C2 and C3, and with the seal ring 41 of drive cylinder C4 respectively. The seals 56–59 and the bore *x* and annuli *a–c* separated thereby are in open communication through the manifold header 55 and into the individually separate hose connections 27 for ultimate control as circumstances require.

Figure 7:
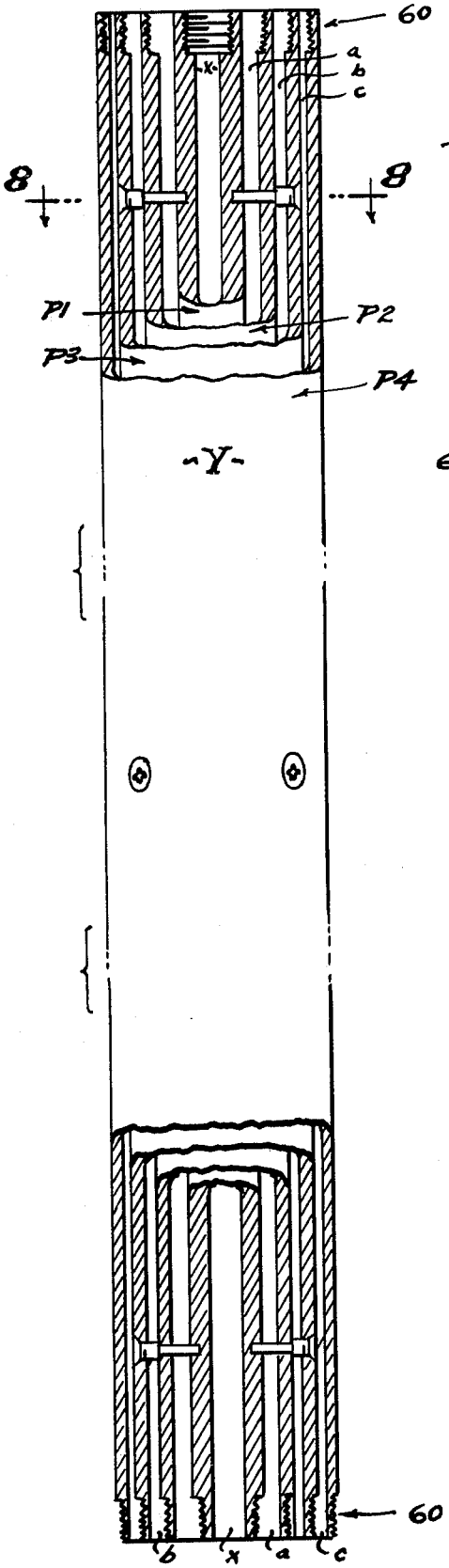
FIG. 7 is an elevation, partially in section, of an assembled section of multiple drill pipe.
Figure 9:
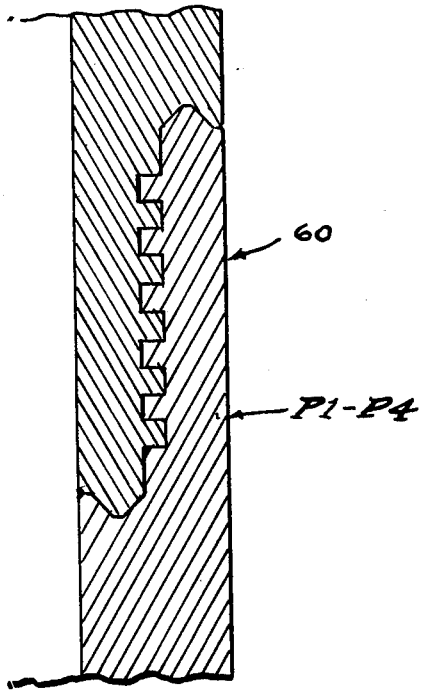
FIG. 9 is an enlarged detailed fragmentary view of the pin and box coupling joints between drill pipe sections.

Referring now to the drill string Y, there is a multiplicity of coaxial drill pipes P1, P2, P3, and P4 operated simultaneously by the Top Head Drive X, to penetrate a geological formation with the acquisition of particulate matter therefrom by means of reverse air vacuum circulation applied through the plurality of fluid circuits made available by said multiple drill strings. As shown in FIG. 7, each section of multiple drill string is comprised of pin and box coupling joints 60 continuous with the inside and outside diameters of the pipe, in each instance. Accordingly, the coupling section of the drive cylinders C1, C2 and C3 and of the driving coupling ring 42 of drive cylinder C4 are reduced to the corresponding drill pipe diameters (inside and outside), and to the end that a uniformly smooth walled bore *x* and annuli *a–c* are provided. As shown in FIG. 9 the coupling joints comprise a threaded pin and box with a V-shaped shoulder in the opposed faces thereof so as to keep the mating pipe or coupling ends from spreading.

Figure 4:
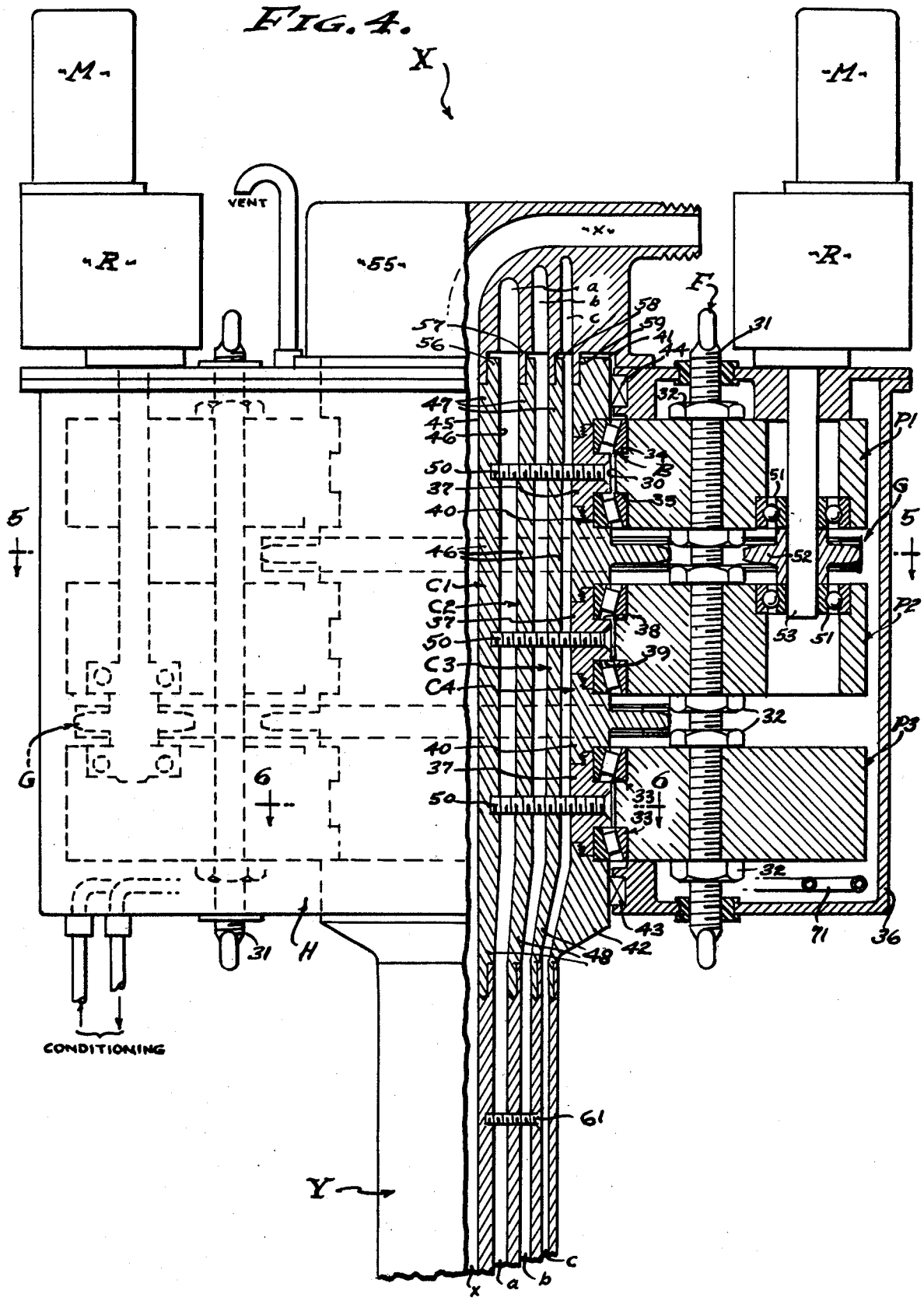
FIG. 4 is an enlarged detailed sectional view of the Top Head Drive and taken as indicated by line 4—4 on FIG. 1.
Figure 5:
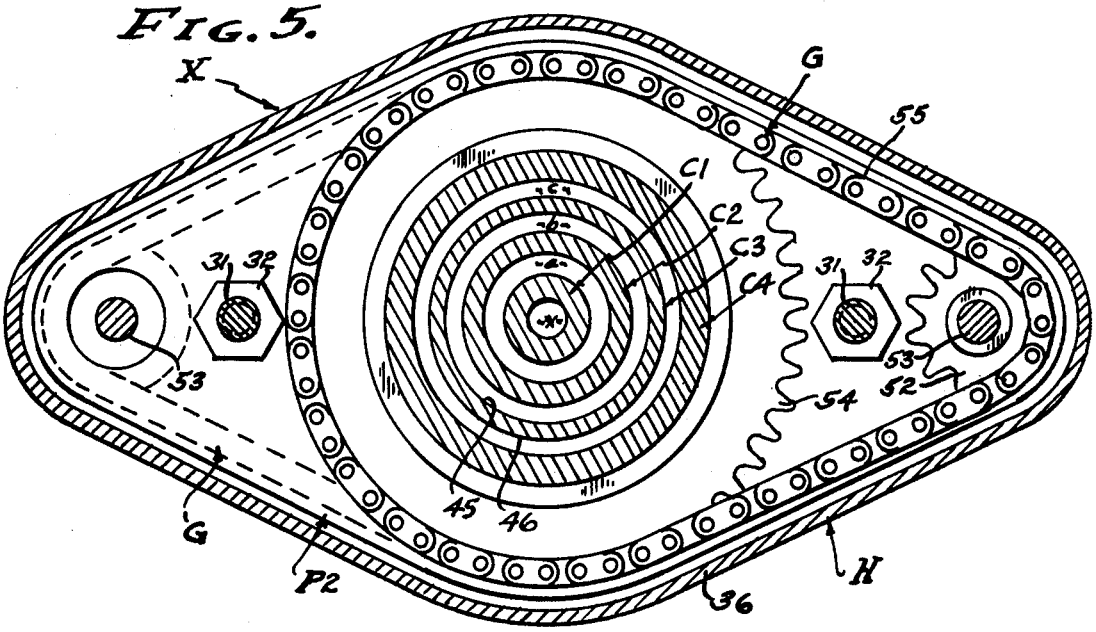
FIG. 5 is a plan sectional view taken as indicated by line 5—5 on FIG. 4.
Figure 8:
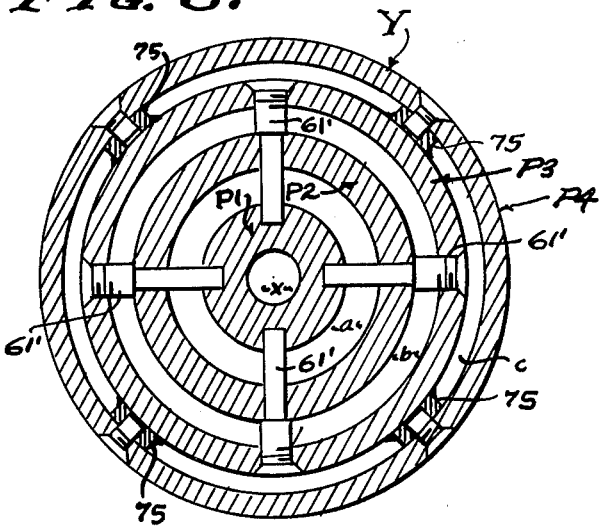
FIG. 8 is an enlarged transverse sectional view of the multiple drill pipe and taken as indicated by line 8—8 of FIG. 7.
Figure 12:
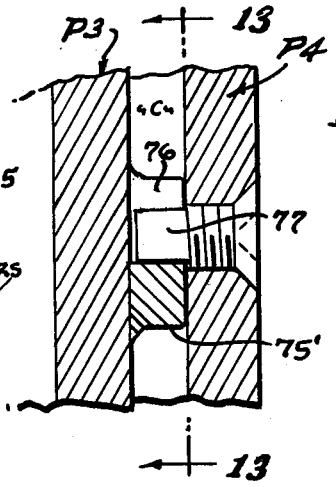
FIG. 12 is an enlarged detailed fragmentary view of the releasable drive means operating between drill pipes.
Figure 13:
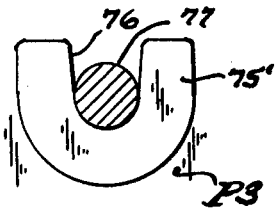
FIG. 13 is a vertical sectional view taken as indicated by line 13—13 on FIG. 12.

In accordance with this invention, the multiple drill pipe sections are available as assemblies (see FIG. 7) of a multiplicity of drill pipes, joined together in driving relationship by circumferentially spaced coupling pins 61 threaded radially through the drill pipes to be joined in the assembly (see FIG. 4). As shown in FIGS. 7 and 8, there are shouldered drive pins 61' projecting inwardly from the outermost drill pipe P3 of the assembly; for example, seated in drill pipe P1, with stepped engagement through drill pipe P2, and threadedly locked in drill pipe P3. As shown, drill pipes P1, P2 and P3 are assembled in concentric relation by the coupling pins 61 (or 61') threadedly locked in the latter drill pipe, and leaving the drill pipe P4 free to be set in the well hole for completion if so desired, in which case centering blocks 75 are placed within the annulus *c*. In carrying out the invention, the centering blocks 75 are carried by the next innermost drill pipe or pipe P3, as by welding thereto; for example simple space occupying blocks slideably engageable within drill pipe P4. As shown in FIGS. 12 and 13 blocks 75' are slotted at 76 to open upwardly for the reception of drive pin heads 77 projecting inwardly from the drill pipe P4; in which case a sufficient stand of drill pipe below the Top Head Drive X is devoid of slotted blocks 75 and drive pins 77 so as to enable the outermost drill pipe P4 to be turned and released from the multi-pipe assembly at the top of the string and revolved at the coupling ring 42 for uncoupling when so required, by removing the drive pins 77 at the uppermost section or sections of drill pipe and by then applying torque between drill pipe P4 and the remaining pipes which remain coupled by the coupling pins 61 (61'). It will be seen that the multiplicity of drill strings can be extended section by section, as completely pre-assembled or partially assembled sections, with uninterrupted continuity of the bore *x* and annuli *a–c*. The annulus *d* is at the exterior of the drill pipe assembly, and with the bore hole is capped off by means 59 (see FIG. 1) and directed to manifold means 25 via a hose connection 27.

Figure 10:
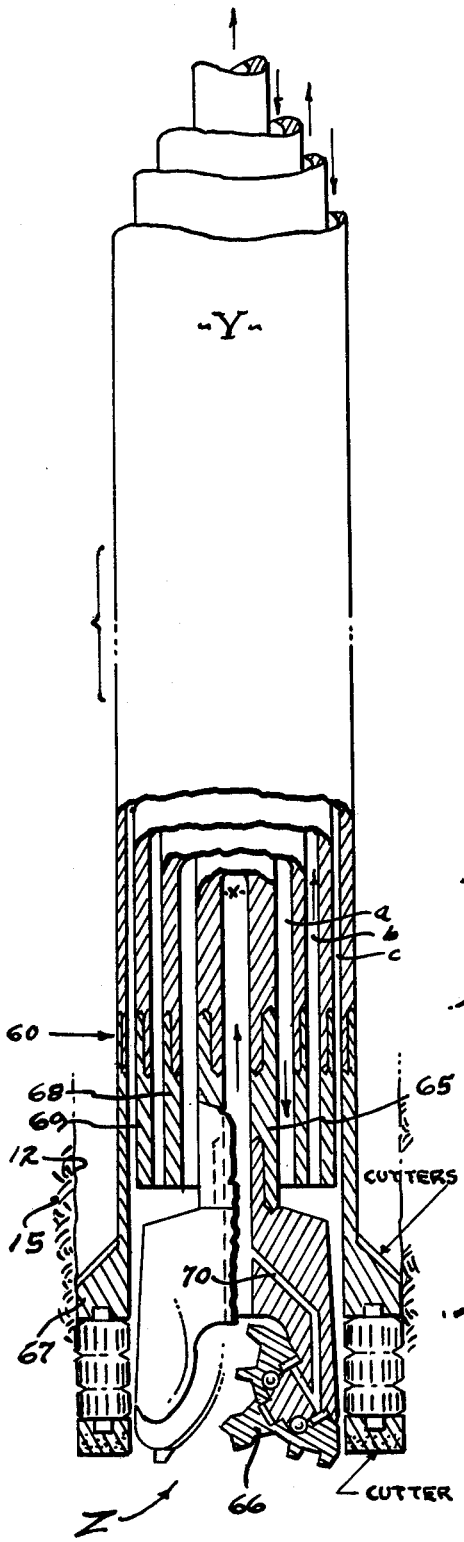
FIG. 10 is an elevation, partially in section, of the multiple drill pipe and an earth boring assembly operated thereby.
Figure 11:
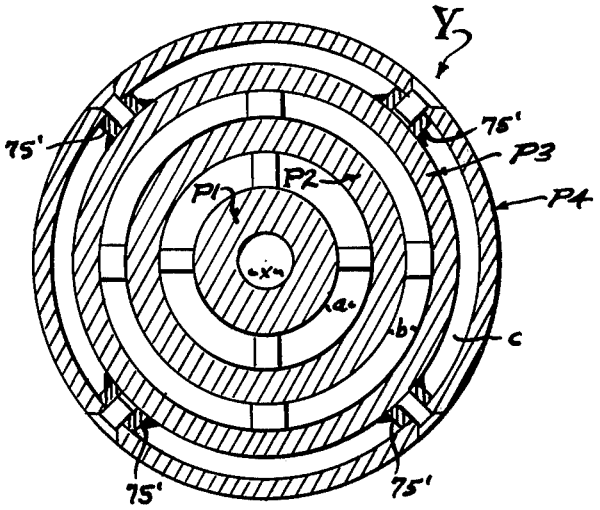
FIG. 11 is an enlarged transverse sectional view of the outermost drill pipe releasably driven as part of the multiple drill pipe assembly.

Referring now to the drilling tools Z, a useful combination of multiple tools is shown, and as best illustrated in FIG. 10 the lowermost section of drill pipe P1 carries a sub 65 driving a roller bit 66 that roughs out the bottom of the well bore. Immediately above and/or surrounding the roller bit 66 the lowermost section of drill pipe P4 carries a deep skirted reamer or bit 67 that finishes out the well bore diameter so as to clear and receive the said pipe P4. Bit 67 differs from the more conventional roller bit 66 in the provision therein of the narrow skirting below a multiplicity of rollers so as to establish a high velocity air stream and back up area for particulate matter adjacent the cutters of said two bits 66 and 67. A typical vacuum nozzle combination is shown, wherein the vacuum manifold 25 is opened to bore *x* and annulus *a*, and air and/or other fluids introduced at high velocity under pressure (by means not shown) through the annuli *b* and *c* (*d* shown closed). As shown, each drill pipe not equipped with a drilling tool can be equipped with a servicing tool such as the shoes 68 and 69 of nozzle configuration when combined telescopically one within the other; a typical configuration being the flared or bell-shapes thereof which direct fluid to and from the periphery of the bits 66 and 67. A feature of this invention is the porting 70 from the roller cutter bearings for cleaning them and keeping them free of the particulate drill cuttings. It will be observed that the multiplicity of drilling strings P1, P2 and P3 are retractile with the bit 66 through the drill pipe P4 and its bit 67, in the event that the latter is to remain or be set in the well hole as a casing.

From the foregoing it will be seen that the drilling apparatus of the present invention employs a high velocity dynamic principle for removing the particulate cuttings in the form of geological dust and chips or fragments as they are removed from the bottom of the well bore. In normal operation, air movement is downward through any one of the annular spaces between the multiple drill pipes, or upwardly therethrough (including the central bore and well bore annulus). The fluids to be circulated are commutated through the swivel-manifold S and through the hose connections 27 to the valves V1–V5 of manifold 25, and then to the top of the cyclonic separator 24 where the heavier particulate matter is removed by centrifugal force and dropped down into containers (see U.S. Pat. Nos. 3,887,020 and 3,968,845) wherein the particulate matter is acquired and observed as a representation of the materials of the strata being drilled. The character of the material being drilled is assessed as to its hardness, density and other characteristics taken at any time from the continuous core sample removed during a drilling operation, so as to give an exact representation of the strata being drilled. These continuously produced samples are immediately available for analyzing the strata of the geological formations through which a well penetrates, and all of which can be retained for reference purposes.

Having described only a typical preferred form and applications of my invention, I do not wish to be limited or restricted to the specific details herein set forth, but wish to reserve to myself any modifications or variations that may appear to those skilled in the art:

I claim:

1. A method of drilling and continuously sampling geological formations and including the steps of:

forming a continuous bore hole in the earth by drilling with a multiplicity of at least two concentric drill pipes and each of which rotates a drill bit;

removing particulate matter from the drill bits at the bottom of the bore hole by means of reverse air vacuum and entrainment thereof in at least one fluid circuit pumped through the center drill pipe and annulus within the other drill pipe;

separating the entrained particulate matter from said fluid circuit;

and, continuously collecting the separated particulate matter for disposition and core sampling.

2. The method of drilling and continuously sampling as set forth in claim 1 wherein, a plurality of fluid circuits are pumped at high velocity and at high vacuum for the entrainment of particulate matter through the center drill pipe and an annulus within another concentric drill pipe and used for separate purposes.

3. The method of drilling and continuously sampling as set forth in claim 1, wherein a plurality of fluid circuits are pumped through the center drill pipe and annuli within other concentric drill pipes and used for separate purposes.

4. The method of drilling and continuously sampling as set forth in claim 1, wherein the fluid circuit is pumped at high velocity for the entrainment of said particulate matter.

5. The method of drilling and continuously sampling as set forth in claim 1, wherein the fluid circuit is pumped at a high vacuum for the entrainment of said particulate matter.

6. The method of drilling and continuously sampling as set forth in claim 1 wherein, the fluid circuit is pumped at high velocity and at high vacuum for the entrainment of said particulate matter.

7. The method of drilling and continuously sampling as set forth in claim 1 wherein, the fluid circuit is air pumped at high velocity for the entrainment of said particulate matter.

8. The method of drilling and continuously sampling as set forth in claim 1 wherein, the fluid circuit is air pumped at high vacuum for the entrainment of said particulate matter.

9. The method of drilling and continuously sampling as set forth in claim 1 wherein, the fluid circuit is air pumped at high velocity and at high vacuum for the entrainment of said particulate matter.

10. The method of drilling and continuously sampling as set forth in claim 1 wherein, a plurality of fluid circuits are pumped at high velocity for the entrainment of particulate matter through the center drill pipe and an annulus within another concentric drill pipe and used for separate purposes.

11. The method of drilling and continuously sampling as set forth in claim 1 wherein, a plurality of fluid circuits are pumped at high vacuum for the entrainment of particulate matter through the center drill pipe and an annulus within another concentric drill pipe and used for separate purposes.

12. A method of drilling and continuously sampling and string conversion in geological formations and including the steps of:

forming a continuous bore hole in the earth by drilling with a multiplicity of at least two concentric drill pipes simultaneously rotated with a drill bit on one drill pipe removable through a drill bit on and through the outermost drill pipe;

removing particulate matter from the drill bits at the bottom of the bore hole by entrainment thereof in at least one fluid circuit pumped through the center drill pipe and annulus within the other drill pipe;

separating the entrained particulate matter from said fluid circuit;

continuously collecting the separated particulate matter for disposition and core sampling;

and, converting the outermost drill pipe into a casing by setting the same in the bore hole and by separately operating the first mentioned drill bit and one drill pipe through said outermost converted drill pipe and drill bit remaining thereon.

13. The method of drilling and continuously sampling string conversion as set forth in claim 12 wherein, a fluid circuit is pumped through the annulus within said converted drill pipe set in the bore hole, and through annuli within a multiplicity of drill pipes operating within said converted drill pipe.

14. The method of drilling and continuously sampling and string conversion as set forth in claim 12 wherein, a fluid circuit is pumped through the annulus within said converted drill pipe set in the bore hole.

15. The method of drilling and continuously sampling and string conversion as set forth in claim 12 wherein, a fluid circuit is pumped through an annulus within a drill pipe operating within said converted drill pipe set in the bore hole.

16. The method of drilling and continuously sampling and string conversion as set forth in claim 12 wherein, a fluid circuit is pumped through the annuli within a multiplicity of drill pipes operating within said converted drill pipe set in the bore hole.

17. The method of drilling and continuously sampling and string conversion as set forth in claim 12 wherein, a fluid circuit is pumped through the annulus within said converted drill pipe set in the bore hole, and an annulus within a drill pipe operating within said converted drill pipe.

18. Apparatus for drilling and continuously sampling geological formations, and including:

a multiplicity of at least two concentric drill pipes defining fluid channels extending centrally therethrough and therebetween, and separate drill means carried at the lower end of the central and outermost drill pipes respectively for forming a continuous bore hole in the earth;

means for driveably rotating, raising and lowering said concentric drill pipes, and having a swivel-manifold with separate connections in fluid communication with fluid channels extending centrally therethrough and therebetween;

means for selectively pumping fluid through said swivel-manifold in separate communication with said fluid channels;

and, means continuously separating particulate matter entrained in said fluid from the drill means at the bottom of the bore hole, for disposition and core sampling.

19. The apparatus for drilling and continuously sampling as set forth in claim 18 wherein, the multiplicity of drill pipes are concentrically centered in spaced relation by means driveably assembling the same into sections coupled together as a string.

20. The apparatus for drilling and continuously sampling as set forth in claim 18 wherein, the central drill pipe and bit is retractable through the outermost drill pipe and bit.

21. The apparatus for drilling and continuously sampling as set forth in claim 18 wherein, the means for driveably rotating, raising and lowering said concentric drill pipes comprises a multiplicity of at least two concentric drive cylinders defining fluid channels extending centrally therethrough and therebetween, and drive coupling means for separate communication with complementary fluid channels through the multiplicity of at least two concentric drill pipes.

22. The apparatus for drilling and continuously sampling as set forth in claim 18 wherein, the means for driveably rotating, raising and lowering said concentric drill pipes comprises a multiplicity of at least two concentric drive cylinders concentrically centered in spaced relation by means driveably assembling the same into a unit defining fluid channels extending centrally therethrough and therebetween, and drive coupling means for separate communication with complementary fluid channels through the multiplicity of at least two concentric drill pipes concentrically centered in spaced relation by means driveably assembling the same into sections coupled together as a string.

23. The apparatus for drilling and continuously sampling as set forth in claim 18 wherein, the means for selectively pumping fluid separately communicates a high vacuum with at least one of said fluid channels.

24. The apparatus for drilling and continuously sampling as set forth in claim 18 wherein, the means for selectively pumping fluid separately communicates a high velocity flow of fluid at high vacuum with at least one of said fluid channels.

25. The apparatus for drilling and continuously sampling as set forth in claim 18 wherein, the means for driveably rotating, raising and lowering said concentric drill pipes comprises a multiplicity of at least two concentric drive cylinders defining said fluid channels extending centrally therethrough and therebetween, and drive coupling means for separate communication with complementary fluid channels through the multiplicity of at least two concentric drill pipes, and wherein the means for selectively pumping fluid separately communicates a high vacuum with at least one of said fluid channels.

26. The apparatus for drilling and continuously sampling as set forth in claim 18 wherein, the means for driveably rotating, raising and lowering said concentric drill pipes comprises a multiplicity of at least two concentric drive cylinders concentrically centered in spaced relation by means driveably assembling the same into a unit defining said fluid channels extending centrally therethrough and therebetween, and drive coupling means for separate communication with complementary fluid channels through the multiplicity of at least two concentric drill pipes concentrically centered in spaced relation by means driveably assembling the same into sections coupled together as a string, and wherein the means for selectively pumping fluid separately communicates a high velocity flow of fluid at high vacuum with at least one of said fluid channels.

27. A drill pipe section assembly for high velocity reverse vacuum rotary drilling and continuous sampling, and including; a multiplicity of at least two concentric drill pipes defining fluid channels extending centrally therethrough and therebetween, means comprised of circumferentially spaced screw pins threadedly engaged radially therethrough and driveably interconnecting at least two of said drill pipes in concentric relation with a uniform annulus therebetween, and pin and box coupling portions at the opposite ends of the drill pipes respectively.

28. The multiple drill pipe section assembly as set forth in claim 27 wherein, the circumferentially spaced screw pins are self locking pins threadedly engaged radially therethrough.

29. The multiple drill pipe section assembly as set forth in claim 27 wherein, the means driveably interconnecting the multiplicity of concentric drill pipes comprises circumferentially spaced and radially disposed screw pins threadedly engaged radially inward therethrough from the outermost drill pipe to which they are interconnected, and wherein the outermost drill pipe of said interconnected multiplicity thereof releasably drives a surrounding drill pipe by means of circumferentially spaced drive lugs projecting from the outermost drill pipe of said interconnected multiplicity thereof and having axially open slots in said lugs to receive removable drive pins projecting inwardly from said surrounding drill pipe.

30. The multiple drill pipe section assembly as set forth in claim 27 wherein, the outermost drill pipe of said concentric multiplicity thereof is rotatably free of said means driveably interconnecting the other drill pipes one within the other.

31. The multiple drill pipe section assembly as set forth in claim 27 wherein, the circumferentially spaced and radially disposed pins are stepped pins with shouldered engagement against successively larger pipe diameters.

32. The multiple drill pipe section assembly as set forth in claim 27 wherein, the circumferentially spaced and radially disposed pins are stepped pins with shouldered engagement against successively larger pipe diameters and screw threaded into the outermost drill pipe to which they are interconnected.

33. The multiple drill pipe section assembly as set forth in claim 27 wherein, the pin and box coupling comprises complementary male and female threads of constant diameter terminating in circumferentially mated V-shaped buttress shoulders to prevent radial spreading, and wherein the coupling portions of the drill pipe are of uniform dimensions coincidental with both the inside and outside diameters of said drill pipes respectively.

34. The multiple drill pipe section assembly as set forth in claim 27 wherein, the pin and box coupling comprises complementary male and female threads of substantially square configuration and of constant diameter terminating in circumferentially mated V-shaped buttress shoulders to prevent radial spreading, and wherein the coupling portions of the drill pipe are of uniform dimensions coincidental with both the inside and outside diameters of said drill pipes respectively.

35. The multiple drill pipe section assembly as set forth in claim 27 wherein, the outermost drill pipe of said concentric multiplicity thereof is releasably driven from an inner drill pipe by means of circumferentially spaced drive lugs projecting from an inner drill pipe and having axially open slots to receive drive pins projecting inwardly from an outermost drill pipe.

36. A Top Head Drive for drilling and continuously sampling geological formations by operating a string of at least two concentric drill pipes defining fluid channels extending centrally therethrough and therebetween to conduct at least one fluid circuit for purposes including the entrainment of particulate matter from drill means rotated thereby, and comprising:

a frame surrounding a central drive string axis and having a drive axis in spaced parallel relation thereto;

an assembly of at least two concentric drive cylinders interconnected by means of circumferentially spaced drive pins engaged radially therethrough and defining fluid channels extending centrally therethrough and therebetween to conduct a plurality of fluid circuits, and means driveably interconnecting all of said drive cylinders as an assembly;

bearing means between the outermost drive cylinder and surrounding frame with the drive cylinder assembly disposed on said central drive string axis;

a gear means operable between the outermost drive cylinder of the drive cylinder assembly and said drive axis;

a motor means mounted on the frame at said drive axis and having a transmission shaft applying torque to said gear means and controlled as to direction of rotation and speed;

a swivel-manifold at the upper end of the drive cylinder assembly and having a plurality of fluid channels in separate fluid communication with complementary fluid channels through and between said at least two concentric drive cylinders;

and, drive coupling means at the lower end of the drive cylinder assembly for separate communication of complementary fluid channels of the aforesaid at least two concentric drill pipes and said at least two concentric drive cylinders respectively.

37. The Top Head Drive as set forth in claim 36 wherein, the circumferentially spaced drive pins are screw pins threadedly engaged radially therethrough.

38. The Top Head Drive as set forth in claim 36 wherein, the circumferentially spaced drive pins are self locking screw pins threadedly engaged radially therethrough.

39. The Top Head Drive as set forth in claim 36 wherein, the circumferentially spaced drive pins are stepped pins with shouldered engagement against successively larger cylinder diameters.

40. The Top Head Drive as set forth in claim 36 wherein, the circumferentially spaced drive pins are stepped pins with shouldered engagement against successively larger cylinder diameters and screw threaded into the outermost cylinder rotatably carried in said bearing means.

41. A Top Head Drive for drilling and continuously sampling geological formations by operating a string of at least two concentric drill pipes defining fluid channels extending centrally therethrough and therebetween to conduct at least one fluid circuit for purposes including the entrainment of particulate matter from drill means rotated thereby, and comprising:

a frame comprised of at least one pair of carrier plates with aligned openings therethrough surrounding a central drive string axis and having a drive axis in spaced parallel relation thereto;

at least two concentric drive cylinders defining fluid channels extending centrally therethrough and therebetween to conduct a plurality of fluid circuits, and means driveably interconnecting all of said drive cylinders as an assembly;

bearing means between the outermost drive cylinder and surrounding carrier plates with the drive cylinder assembly rotatably disposed on said central drive string axis;

a gear means operable intermediate each pair of carrier plates and between the outermost drive cylinder of the drive cylinder assembly and said drive axis;

a motor means mounted on the frame at said drive axis and having a transmission shaft applying torque to said gear means and controlled as to direction of rotation and speed;

a swivel-manifold at the upper end of the drive cylinder assembly and having a plurality of fluid channels in separate fluid communication with complementary fluid channels through and between said at least two concentric drive cylinders;

and, drive coupling means at the lower end of the drive cylinder assembly for separate communication of complementary fluid channels of the aforesaid at least two concentric drill pipes and said at least two concentric drive cylinders respectively.

42. The Top Head Drive as set forth in claim 41 wherein, the at least one pair of carrier plates are spaced axially by tie rods with stops that position the carrier plates relative to each other.

43. The Top Head Drive as set forth in claim 41 wherein, the at least one pair of carrier plates are spaced axially by tie rods with nuts threadedly engaged thereon to position the carrier plates relative to each other.

44. The Top Head Drive as set forth in claim 41 wherein, the bearing means comprises axially and radially opposed seats in the outermost cylinder of the drive cylinder assembly and said at least one pair of carrier plates respectively.

45. The Top Head Drive as set forth in claim 41 wherein, the bearing means comprises axially and radially opposed seats in the outermost cylinder of the drive cylinder assembly and said at least one pair of carrier plates respectively, and wherein the carrier plates are spaced axially to pre-load said bearing means by means of tie rods with stops that position the plates relative to each other.

46. The Top Head Drive as set forth in claim 41 wherein, the bearing means comprises axially and radially opposed seats in the outermost cylinder of the drive cylinder assembly and said at least one pair of carrier plates respectively, and wherein the carrier plates are spaced axially to pre-load said bearing means by means of tie rods with nuts threadedly engaged thereon to position the plates relative to each other.

47. A Top Head Drive for drilling and continuously sampling geological formations by operating a string of at least two concentric drill pipes defining fluid channels extending centrally therethrough and therebetween to conduct at least one fluid circuit for purposes including the entrainment of particulate matter from drill means rotated thereby, and comprising:

a frame surrounding a central drive string axis and having at least two drive axes equally spaced in circumferential and parallel relation thereto;

at least two concentric drive cylinders defining fluid channels extending centrally therethrough and therebetween to conduct a plurality of fluid circuits, and means driveably interconnecting all of said drive cylinders as an assembly;

bearing means between the outermost drive cylinder and surrounding frame with the drive cylinder assembly disposed on said central drive string axis;

a gear means operable between the outermost drive cylinder of the drive cylinder assembly and each of said at least two drive axes;

a motor means mounted on the frame at each of said drive axes and each having a transmission shaft applying equal torque to said gear means and controlled as to direction of rotation and speed;

a swivel-manifold at the upper end of the drive cylinder assembly and having a plurality of fluid channels in separate fluid communication with complementary fluid channels through and between said at least two concentric drive cylinders;

and, drive coupling means at the lower end of the drive cylinder assembly for separate communication of complementary fluid channels of the aforesaid at least two concentric drill pipes and said at least two concentric drive cylinders respectively.

48. The Top Head Drive as set forth in claim 47 wherein, each of the gear means is a chain and sprocket drive.

49. The Top Head Drive as set forth in claim 47 wherein, each of the gear means is a speed reducing chain and sprocket drive.

50. The Top Head Drive as set forth in claim 47 wherein, each of the motor means comprises a variable speed prime mover and a variable ratio speed reducer.

51. The Top Head Drive as set forth in claim 47 wherein, each of the motor means comprises a hydrostatically controlled variable speed hydraulic prime mover connected to the said transmission shaft.

52. The Top Head Drive as set forth in claim 47 wherein, each of the motor means comprises a hydrostatically controlled variable speed hydraulic powered prime mover and a selective speed multi ratio speed reducer connecting the same to the said transmission shaft.

53. A Top Head Drive for drilling and continuously sampling geological formations by operating a string of at least two concentric drill pipes defining fluid channels extending centrally therethrough and therebetween to conduct at least one fluid circuit for purposes including the entrainment of particulate matter from drill means rotated thereby, and comprising:

a frame comprised of pairs of carrier plates with aligned openings therethrough surrounding a central drive string axis and having at least two drive axes equally spaced in circumferential and parallel relation thereto;

at least two concentric drive cylinders defining fluid channels extending centrally therethrough and therebetween to conduct a plurality of fluid circuits, and means driveably interconnecting all of said drive cylinders as an assembly;

bearing means between the outermost drive cylinder and surrounding carrier plates with the drive cylinder assembly rotatably disposed on said central drive string axis;

a gear means operable intermediate each pair of carrier plates and between the outermost drive cylinder of the drive cylinder assembly and each of said at least two drive axes;

a motor means mounted on the frame at each of said drive axes and each having a transmission shaft applying equal torque to said gear means and controlled as to direction of rotation and speed;

a swivel-manifold at the upper end of the drive cylinder assembly and having a plurality of fluid channels in separate fluid communication with complementary fluid channels through and between said at least two concentric drive cylinders;

and, drive coupling means at the lower end of the drive cylinder assembly for separate communication of complementary fluid channels of the aforesaid at least two concentric drill pipes and said at least two concentric drive cylinders respectively.

54. The Top Head Drive as set forth in claim 53 wherein, the pairs of carrier plates are spaced axially by tie rods with stops that position the plates relative to each other, and wherein each of the gear means is a chain and sprocket drive.

55. The Top Head Drive as set forth in claim 53 wherein, the pairs of carrier plates are spaced axially by tie rods with nuts threadedly engaged thereon to position the plates relative to each other, and wherein each of the gear means is a speed reducing chain and sprocket drive.

56. The Top Head Drive as set forth in claim 53 wherein, the bearing means comprises axially and radially opposed seats in the outermost cylinder of the drive cylinder assembly and pairs of plates respectively, and wherein each of the motor means comprises a variable speed prime mover and a variable ratio speed reducer.

57. The Top Head Drive as set forth in claim 53 wherein, the bearing means comprises axially and radially opposed seats in the outermost cylinder of the drive cylinder assembly and pairs of plates respectively, and wherein the pairs of carrier plates are spaced axially to pre-load said bearing means by means of tie rods with stops that position the plates relative to each other, and wherein each of the motor means comprises a variable speed hydraulic prime mover and a multi ratio speed reducer to the said transmission shaft.

58. The Top Head Drive as set forth in claim 53 wherein, the bearing means comprises axially and radially opposed seats in the outermost cylinder of the drive cylinder assembly and pairs of plates respectively, and wherein the pairs of carrier plates are spaced axially to pre-load said bearing means by means of tie rods with nuts threadedly engaged thereon to position the plates relative to each other, and wherein each of the motor means comprises a hydrostatically controlled variable speed hydraulic powered prime mover and a selective speed multi ratio speed reducer connecting the same to the said transmission shaft.

* * * * *